United States Patent [19]

Hiromori

[11] Patent Number: 4,761,862

[45] Date of Patent: Aug. 9, 1988

[54] CLIP USED FOR BUSINESS

[75] Inventor: Junji Hiromori, Tokyo, Japan

[73] Assignee: Hiromori Industrial Company, Taito, Japan

[21] Appl. No.: 27,303

[22] Filed: Mar. 18, 1987

[30] Foreign Application Priority Data

Mar. 19, 1986 [JP] Japan ..... 61-39040[U]

[51] Int. Cl.[4] ..... B24F 1/02

[52] U.S. Cl. ..... 24/67.9; 24/67.5; 40/658; 400/493.1

[58] Field of Search ..... 24/67.9, 67.11, 67.5, 24/67.1, 67.3, 67 R, 67.7, 545, 546, 502, 536, 90 A, 621, 163 K; 40/10 R; 400/493, 493.1, 493.2, 400

[56] References Cited

U.S. PATENT DOCUMENTS

| | | | |
|---|---|---|---|
| 2,059,615 | 11/1936 | Smith | 400/493.1 |
| 2,189,066 | 2/1940 | Helmond | 400/493.1 |
| 3,286,381 | 11/1966 | Wodge | 24/67.5 |
| 3,645,022 | 2/1972 | Anderson | 40/10 R |
| 4,052,773 | 10/1977 | Nesbitt | 24/163 K |
| 4,532,680 | 8/1985 | Hashimoto | 24/67.9 |

*Primary Examiner*—Victor N. Sakran

*Attorney, Agent, or Firm*—Oldham, Oldham & Weber

[57] ABSTRACT

A clip used for business composed of a flat finger patch provided with fitting groove formed at a peripheral edge thereof, the height of one of groove edge of said patch being lower than that of the other groove edge, each holding portion of operational levers being fitted into fitting groove of said operational levers and said lower groove edge being arranged to be an inner side of said patch in fitting the same into said holding portion when said operational levers are risen simultaneously.

5 Claims, 4 Drawing Sheets

CLIP USED FOR BUSINESS

BACKGROUND OF THE INVENTION

1. Field of the Invention

The present invention relates to a clip used for business for filing paper etc.

2. Description of the Prior Art

A clip used for business for filing paper etc is in general composed of a main body thereof formed by bending a flat plated spring material so as to turn into substantially an equilateral triangle in section and a pair of operational levers made of a metallic wire raising and falling down free disposed at both sides of opening edges of said main body.

According to such conventional clip as above, when falling down the operational levers while holding paper etc therebetween, said operational levers lay down along both surfaces of said paper etc; and accordingly it has such advantage as easy arrangement and custody thereof because of lessened spaced.

On the other hand, however, according to such conventional clip as above, there was such defect that the opening edges are forced to open by pressing metallic operational levers inward with fingers while holding the same so as to open the main body of the clip; and as a result said levers are apt to deeply touch with the fingers at that time, thereby causing some pain to the fingers and further causing operational difficulty accordingly.

SUMMARY OF THE INVENTION

Accordingly, it is a general object of the present invention is to provide a clip used for business which an operational lever will not deeply touch with the fingers to cause pain.

The object of the present invention can be achieved by a clip used for business according to the present invention which comprises a flat finger patch provided with a fitting groove formed at a peripheral edge thereof, the height of one of groove edge of said patch being lower than that of the other groove edge, each holding portion of operational levers being fitted into fitting groove of said operational levers and when said operational levers being raised simultaneously said lower groove edge being arranged to be the inner side of said patch in fitting the same into said holding portion.

Thus, according to the clip used for business of the present invention, the opening edges of a main body of the clip can be easily opened against the spring force of said main body by pressing a finger patch of an operational lever of the clip inward with fingers when a pair of said operational levers are in a rasing condition, so that said operational lever may not deeply touch with the fingers to cause pain.

Furthermore, since said finger patch is arranged to fit into a holding portion of the operational lever formed by bending a metallic wire, said patch may be formed to be flat with a suitable thickness thereof and further a higher groove edge side thereof is arranged to transmit the inward pressing force to the holding portion; and accordingly said pressing force can be applied to each portion of said holding portion almost uniformly. Still furthermore, there is no fear in an actual use of the clip that the finger patch will not slip off out of the holding portion due to said pressing force.

Still furthermore, when the operational levers are in a falling condition for non-use thereof, said patch pressed inward with fingers can be formed to be flat with a suitable thickness; and thus said patch will not be bulky to occupy surplus space to be hindrance to an arrangement thereof.

BRIEF DESCRIPTION OF THE DRAWINGS

The present invention is further described in connection with the drawings; in which:

FIG. 1(*b*) is a side view thereof.

FIG. 1(*c*) is an enlarged sectional view of the portion marked K in FIG. 1(*b*).

FIG. 2(*b*) is a side view thereof.

FIG. 3(*b*) is a side view thereof.

FIG. 4(*b*) is a side view thereof.

FIG. 4(*c*) is a rear view of said finger patch.

DETAILED DESCRIPTION OF THE INVENTION

Figure 1A:
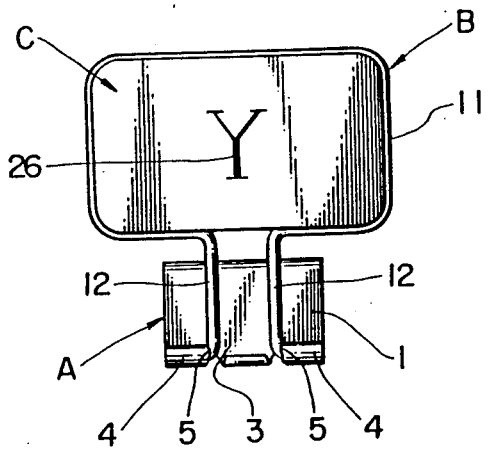
FIG. 1(*a*) is a front view of a clip used for business according to the present invention, wherein operational levers are in a rising condition.

Hereinafter, the embodiment of the clip used for business according to the present invention will be described with reference to the drawings:

In FIG. 1 to FIG. 4, A is a main body of a clip. B is a pair of operational levers for opening and closing opening edges of said main body A and C is a finger patch fitted into holding portions 11,11 of said operational levers. The clip used for business according to the present embodiment is composed of the main body A of the clip, a pair of operational levers B and two finger patches C,C.

Likewise the main body of a conventional clip, said main body A of the clip is formed by bending a plated spring material to turn into substantially an equilateral triangle in section. Said substantially equilateral triangle is formed by a pair of oblique lines 1,1, for holding paper etc therebetween and the base 2 thereof integrally coupled thereto. Free ends i.e. opening edges 3,3, which are alwayys kept to be closed condition owing to spring force, of said oblique lines 11,11 for holding paper etc are curled outward at both ends thereof and four tubular bodies 4 with projecting walls 5 into which four pivotally holding axes 13 of said operational levers B are fitted, are formed. According to the present invention, two tubular bodies each, totaling four bodies are disposed at both ends of said opening edges 3,3; and said two bodies may alternatively disposed only at a middle portion of said opening edges each 3,3.

Figure 3A:
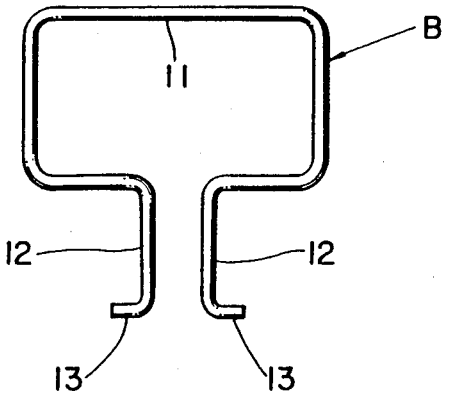
FIG. 3(*a*) is a front view of the operational levers.
Figure 3B:
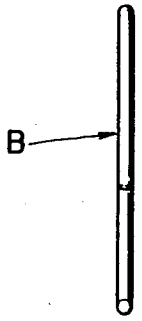
Figure 5A:
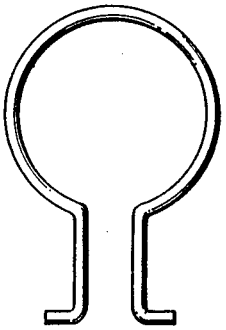
FIG. 5(*a*) is a front view of another operational lever according to the present invention, and FIG. 5(*b*) is a side view thereof.
Figure 5B:
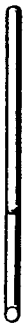
Figure 4A:
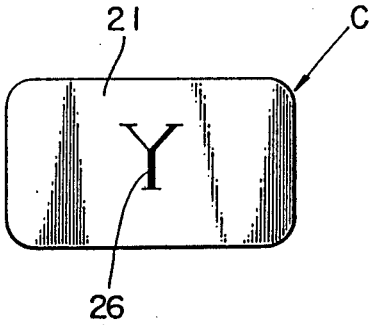
FIG. 4(*a*) is a front view of a finger patch according to the present invention.
Figure 4B:
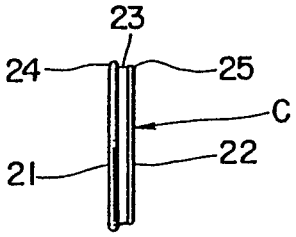
Figure 4C:
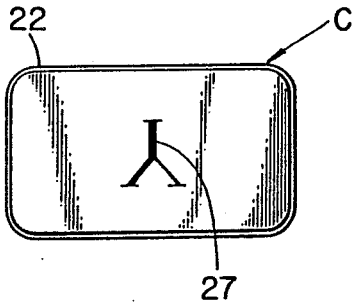

As particularly shown in FIG. 3, said pair of operational levers B are composed of a square holding portion 11 formed by bending a piano wire (the other shapes such as a circle or an oval may also be applicable), a series of a pair of legs 12,12 and a pair of pivotally holding axes 13,13 formed by orthogonally bending outward at the free ends of said legs 12,12. The pivotally holding axes 13,13 of said pair of operational levers B are fitted into the tubular bodies formed at the opening edges 3,3 of said main body A from the inside thereof so as to rotate in a rising and falling manner, centering thereon. In said raising and falling rotation, the space between the legs 12,12 of said pair of operational levers B is forced to lessen against spring forth owing to the projecting walls 5 formed at said four tubular bodies each; and thus unexpected rotation thereof can not be occurred at the end position of raising and falling of said operational levers B unless artificial operational force is applied thereto.

When a tubular body is disposed at a middle portion of the opening edges 3,3 of the main body A of a clip as described above, each pivotally holding axis 13 of said pair of operational levers B is formed by bending orthogonally the free ends of the pair of legs 12,12.

The aforementioned construction are substantially the same as that of a conventional clip used for business and the function thereof is also the same. According to the present embodiment, said detachable finger path C fitted into said holding portions 11, 11 is cloured in various kinds and made of opaque synthetic resins etc with gently touch. Said finger patch C is somewhat thicker than a diameter of the metallic wire for forming the operational lever B; and further somewhat smaller than an external form of said square holding portion 11,11 and somewhat larger than an internal form thereof. Said finger patch C is constituted with a substantially flat similar figure and a groove 23 for fitting the holding portion 11 thereinto is formed at the peripheral edge thereof. At that time, a radius of curvature thereof is arranged to be somewhat smaller than a diameter of the metallic wire for forming the operational lever B and further the height of a groove edge 25 at one side thereof is arranged to be lower than the height of a groove edge 24 at the other side thereof so as to arrange a side enclosed with the groove edge 24 to be the right side 21 and a side enclosed with the groove edge 25 to be the back side 22. On said right side 21 and the back side 22, the same marks 26,27, either of which is marked in a reverse direction, are indicated. In fitting said finger patch C into the holding portions 11,11 of the operational lever B, two finger patches C made of the same material on which the same marks 26,27 are indicated, are selected and then fitted into said holding portions 11,11 in their rasing conditions in a manner that the right side 21 will be the right side. At that time, said patch C is at first fitted into the holding portions 11,11 from the lower groove edges 25,25 which are easy for a fitting operation so as to arrange said lower grooves 25,25 in between the holding portions 11,11.

Figure 1B:
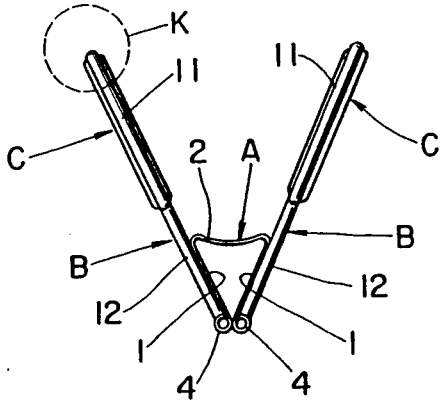
Figure 1C:
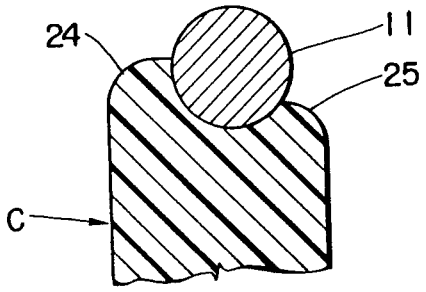
Figure 2A:
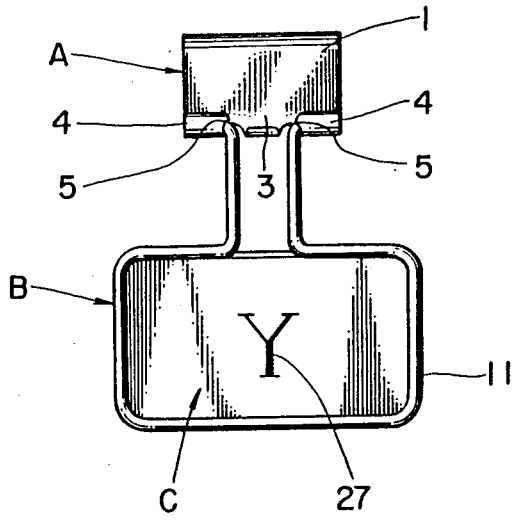
FIG. 2(*a*) is a front view of said clip, wherein the operational levers are in a falling condition.
Figure 2B:
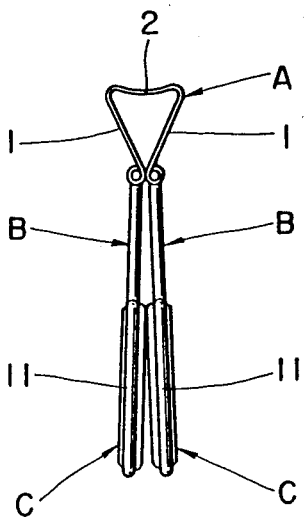

In an actual operation of the finger patch C thus fitted thereinto as above described, after suitably selecting the colours or marks of said patch C having such function as index for arranging paper etc, said pair of operational levers B,B are risen as shown in FIG. 1 and the patches C,C on which uniform force can easily be applied are pressed inward with fingers so as to open the opening edges 3,3 of the main body 4 of a clip against the spring force. At that time, said operational levers B,B will not deeply touch with the fingers to cause pain; and accordingly the above operation is quite smooth and easy. Furthermore, the sides of the higher groove edges 24,24 may apply pressing force to the holding portions 11,11, so that said patches C,C will not easily slip off out of said holding portions 11,11 in spite of a considerable simple construction thereof. Still furthermore, since the thickness of said patches C,C is somewhat thicker than a diameter of the metallic wire for forming the holding portions 11,11, said portions will not be bulky in falling down thereof for custody etc as shown in FIG. 2, so that a treatment thereof becomes considerable easy.

As is clear from the above, according to the present invention, since a flat finger patch is fitted into each holding portion of a pair of operational levers, said levers can easily be operated without deeply toutching with the fingers to cause pain and further the inward pressing force may uniformly transmitted to each portion of said holding portion, thereby facilitating an operation with ease. Furthermore, the height of a groove edge at one side of the fitting groove is arranged to be somewhat lower than that of the other groove edge thereof, thereby facilitating the fitting operation with ease. Still furthermore, since the finger patch with the higher groove edge is arranged at the side to which the inward pressing force is applied, said patch will not slip off out of the holding portion even when strong pressing force is applied thereto and the slip according to the present invention will not be bulky in falling down the operational levers for custody etc of the clip.

Said patch may also be utilized as an index for arranging paper etc depending upon the kinds thereof, so that the arrangement and custody etc of paper etc will be easier and convenient more and more.

What is claimed is:

1. In a clip used for business composed of a main body of a clip formed by bending a plated spring material so as to turn into substantially an equilateral triangle in section and a pair of operational levers made of metallic wire capable of raising and falling free disposed at both sides of opening ends of said main body, the clip used for business comprising:

a flat finger patch provided with a fitting groove formed at a peripheral edge thereof, the height of one groove edge of said patch being lower than that of the other groove edge, each holding portion of said operational levers and when said pair of operational levers being raised simultaneously, said lower groove edge being arranged to be an inner side of said patch in fitting the same into said holding portion.

2. The clip used for business according to claim 1, wherein said finger patch is formed in the shape of a cirle.

3. The clip used for business according to claim 1, wherein said finger patch has such function as an index by indicating suitable colours or marks which can be printed thereon.

4. The clip used for business according to claim 1, wherein said finger patch will not slip off out of the holding portion in pressing inward the same with fingers.

5. The clip used for business according to claim 1 wherein said finger patch is formed is the shape of an oval.

* * * * *